US006590531B2

(12) United States Patent
McKinzie, III et al.

(10) Patent No.: US 6,590,531 B2
(45) Date of Patent: Jul. 8, 2003

(54) PLANAR, FRACTAL, TIME-DELAY BEAMFORMER

(75) Inventors: William E. McKinzie, III, Fulton, MD (US); James D. Lilly, Silver Spring, MD (US)

(73) Assignee: E Tenna Corporation, Laurel, MD (US)

( * ) Notice: Subject to any disclaimer, the term of this patent is extended or adjusted under 35 U.S.C. 154(b) by 0 days.

(21) Appl. No.: 09/863,975

(22) Filed: May 23, 2001

(65) Prior Publication Data

US 2002/0167443 A1 Nov. 14, 2002

Related U.S. Application Data

(60) Provisional application No. 60/285,168, filed on Apr. 20, 2001.

(51) Int. Cl.[7] ..... H01Q 3/22

(52) U.S. Cl. ..... 342/375

(58) Field of Search ..... 342/375, 372; 343/700 MS

(56) References Cited

U.S. PATENT DOCUMENTS

| | | | | | |
|---|---|---|---|---|---|
| 3,124,801 | A | * | 3/1964 | Callahan, Jr. | 342/375 |
| 3,400,405 | A | * | 9/1968 | Patterson, Jr. | 342/375 |
| 4,045,800 | A | * | 8/1977 | Tang et al. | 342/372 |
| 4,117,487 | A | | 9/1978 | Minohara et al. | |
| 4,757,318 | A | | 7/1988 | Pulsifer et al. | 342/375 |
| 5,014,023 | A | | 5/1991 | Mantele | 333/164 |
| 5,027,127 | A | | 6/1991 | Shnitkin et al. | 342/372 |
| 5,307,033 | A | | 4/1994 | Koscica et al. | 333/161 |
| 5,589,845 | A | | 12/1996 | Yandrofski et al. | 343/909 |
| 5,694,134 | A | | 12/1997 | Barnes | 343/700 MS |
| 5,757,319 | A | | 5/1998 | Loo et al. | 342/375 |
| 5,874,915 | A | | 2/1999 | Lee et al. | 342/375 |
| 5,923,289 | A | * | 7/1999 | Buer et al. | 342/373 |
| 5,973,641 | A | * | 10/1999 | Smith et al. | 342/372 |
| 6,097,263 | A | | 8/2000 | Mueller et al. | 333/17.1 |
| 6,124,827 | A | | 9/2000 | Green et al. | 342/375 |
| 6,198,458 | B1 | | 3/2001 | Heinz et al. | 343/853 |
| 6,307,506 | B1 | | 10/2001 | Despain | 706/13 |
| 6,333,712 | B1 | | 12/2001 | Haugse et al. | 342/375 |
| 6,346,924 | B1 | | 2/2002 | Heinz et al. | 343/853 |

OTHER PUBLICATIONS

Puente–Baliarda, C. et al, "On The Behavior of the Sierpinski Multiband Fractal Antenna", IEEE Transactions on Antennas and Propagation, vol. 46, Apr. 1998, pp. 517–524.*

Veihl, J.C. et al, "Reconfigurable Aperture Decade bandwidth Array", IEEE Internatioanl Symposium on Antennas and Propagation Society, Jul. 16–21, 2000, pp. 314–317, vol. 1.*

Werner, Douglas et al, "Fractal Antenna Engineering: The Theory and Design of Fractal Antenna Arrays", IEEE Antennas and Propagation Magazine, vol. 41, No. 5, Oct. 1999, pp 37–59.*

Antenna array architecture, R.J. Mailloux, Proceedings of IEEE, vol. 80(1), pp. 163–172, Jan. 1992.

Circulators for Microwave and Millimeter–Wave Integrated Circuits, E.F. Scholemann, Proceedings of the IEEE, vol. 76(2), pp. 188–200, Feb. 1988.

(List continued on next page.)

*Primary Examiner*—Gregory C. Issing
(74) *Attorney, Agent, or Firm*—Brinks Hofer Gilson & Lione

(57) ABSTRACT

An antenna beamformer is disclosed that uses controllable time delay elements distributed in a planar fractal feed network between the input port and multiple output ports. The use of time delay elements, rather than phase shifting elements, allows the beamformer to maintain a constant steering angle independent of frequencies over a broad range of frequencies. In addition, fewer control signals are used to control all of the time delay elements due to distributing the time delay elements throughout the fractal feed network, rather than grouping the delay elements near the output ports.

94 Claims, 7 Drawing Sheets

OTHER PUBLICATIONS

Applications of Antenna Arrays to Mobile Communications. I. Performance Improvement, Feasibility, and System Considerations, L.C.Gordara, Proceedings of the IEEE, vol. 85(7), pp. 1031–1060, Jul. 1997.

Application of Antenna Arrays to Mobile Communications, II. Beam–Forming and Direction–of–Arrival Considerations, L.C. Godara, Proceedings of the IEEE, Vo. 85(8), pp. 1195–1245, Aug. 1997.

U.S. patent application Ser. No. 09/839,323, Filed Apr. 20, 2001, entitled "Variable Time–delay Microwave Transmission Line".

Boudoucen, H., Issaoun, A., and Djeddi, M., "Analyses of Strips Metallization Effect on the Delay Time of Integrated Circuit Elements", National Institute of Electricity and Electronics, 1993, pp. 1051–1054.

Yun, Tae–Yeoul and Chang, Kai, "A Low–Loss Time–Delay Phase Shifter Controlled by Piezoelectric Transducer to Perturb Microstrip Line", IEEE Microwave and Guided Wave Letters, vol. 10, No. 3, Mar. 2000, pp. 96–98.

* cited by examiner

| | $X_A$ | $X_B$ | $X_C$ | $X_D$ |
|---|---|---|---|---|
| +x | 0 | 1 | 0 | 0 |
| +x,+y | 0 | 1 | 1 | 0 |
| +y | 0 | 0 | 1 | 0 |
| -x,+y | 1 | 0 | 1 | 0 |
| -x | 1 | 0 | 0 | 0 |
| -x,-y | 1 | 0 | 0 | 1 |
| -y | 0 | 0 | 0 | 1 |
| +x,-y | 0 | 1 | 0 | 1 |

FIG. 3

PLANAR, FRACTAL, TIME-DELAY BEAMFORMER

CROSS REFERENCE TO RELATED APPLICATIONS

This application is a non-provisional application claiming priority to provisional application serial No. 60/285,168, filed Apr. 20, 2001.

RELATED FIELD

The present invention relates to an apparatus and method for scanning or pointing the beam of a phased-array antenna via electronic control. More particularly, it relates to an apparatus and method for distributing electromagnetic energy to output ports of a planar antenna array and controlling the time delay between a common input port and any one of multiple output ports by distributing controllable time-delay elements in the pattern of a fractal tree within the antenna feed network.

BACKGROUND

Microwave and millimeter-wave systems, such as air-SATCOM communication links, have been continuously increasing in complexity and density of components due to consumer demands. The increasing number and variety of components, controllers, and connections have correspondingly increased power consumption and may contribute to noise and other interference problems in these systems. The beamformer, an integral component of any such system, has not remained unaffected.

Beamformers (or electronically scanned arrays) may be fabricated in one- or two dimensions. One example of a conventional beamformer for a one-dimensional phased-array antenna is shown in FIG. 6. The conventional beamformer 100 contains an input port 102 to which an electromagnetic signal is fed, transmission lines 104, phase control devices 106 or phase shifters, and output ports 108. The transmission lines 104 are arranged at a power splitter 103 such that the electromagnetic signal from the input port 102 is divided into a plurality of signals with equal or unequal power. The phase shifters 106 adjust the phase of these signals in accordance with control signals 112 provided from an external controller (not shown). Each control signal 112 is provided to an individual phase shifter 106 and may either tune the phase difference of the phase shifter 106 or simply turn on the phase shifter 106 thereby applying a set amount of phase difference. The output ports 108 are connected to radiating elements 110 (e.g. antennas) that transmit the various phase-shifted signals to an external system (not shown). The combination of the phase-shifted signals emitted from the antennas 110 forms an amplitude profile/aperture of the overall beamformer 100.

The phase shifter 106 simulates a time delay for a signal that passes through the phase shifter 106 by altering the phase of the signal. The different phases forming the aperture effectively point the signal through the radiating element 110 at a specific pointing angle or direction toward receiving elements in the external system. To an observer, the phase delays make the signal appear as if it is effectively scanned in time across the output ports 108 at that particular frequency. Conventional phase shifters 106 are typically individual devices that are soldered or fixed into a circuit board, such as PIN diodes (with hybrid circuitry) or other types of ferrite-based devices. As shown, such a conventional beamformer 100 employs one phase shifter 106 at each radiating element 110.

However, conventional beamformers suffer from a number of problems. One disadvantage is that phase shifters are lumped elements and are thus external to the substrate containing the feed network or the antenna array. The phase shifters are thus relatively bulky and expensive. Phase shifters are also generally RF-active devices that require a comparatively large amount of power and may interfere with the transmitted signal. Another disadvantage is that, because the phase shifter alters the phase of an input signal thereby only simulating a time delay, a fixed, progressive time delay between elements is obtained only over a relatively narrow band of frequencies. As a consequence, if the frequency of the beam wanders, the pointing angle wanders correspondingly. For example, using current phase shifters, for high-gain beams, having a gain of around 10 dB, stringent requirements exist: the bandwidth of signals able to be transmitted or received within acceptable margins is only about 5–10%. For low-gain beams, having a gain of around 15 dB, the requirements are somewhat less severe to produce an acceptable beam: the bandwidth may be about 20–30%.

Thus, the beamformer which employs phase shifters only forms a beam at essentially one frequency or a narrow band of frequencies; if the frequency transmitted changes substantially, the antenna element spacing must be either physically moved or the phases set by the phase controllers changed to form a beam at the new frequency (in a controllable-type beamformer array). This process may be time consuming and awkward. Alternatively the process may be physically impossible. Further, this is increasingly important for systems communicating at frequencies that are relatively far apart, some existing and proposed earth-orbiting satellite communication systems communicate simultaneously at approximately 20 and 30 GHz.

Furthermore, as shown, conventional beamformers employ one phase-shifter localized at each radiating element. Thus, a controllable beamformer requires one control signal per antenna element, with associated computer, signal processing, control lines, and control line multiplexing hardware. The resulting beamformer and antenna control unit are typically bulky and extremely expensive, and, as mentioned above, can only form a beam at one frequency.

Accordingly, it would be advantageous to produce a compact, planar, low-cost electronically-controllable high-gain array that can form and steer a beam whose pointing angle is constant at multiple frequencies, or over a broad band of frequencies. Further, it would be advantageous to produce an electronically controllable beamformer in which the pointing angle is controlled using a reduced number of control signals, thereby decreasing the complexity of the control electronics.

BRIEF SUMMARY

The embodiments of the beamformer comprise an input port that is configured to receive an input electromagnetic signal, output ports that are configured to provide output electromagnetic signals, and controllable time delay elements that are disposed between the input port and the output ports. The time delay elements are distributed in a multi-branched feed network, which includes a fractal tree.

Each time delay element may be controlled by an analog voltage or current signal or may be controlled by a digital signal.

The time delay elements may be controlled by fewer control signals than the number of time delay elements.

The fractal tree may comprise a base (or initiator) pattern including a first set of the time delay elements connected symmetrically with the input port and branch (or generator) patterns symmetrically connected with the initiator pattern. Each generator pattern may include a second set of the time delay elements and be connected with a set of the output ports. Or the generator pattern in the fractal tree may be recursively connected to yet another stage of generator patterns in the fractal tree structure. Unique control signals that control the time delay elements may be equal to 1–2 signals per dimension of beam scanning, for example: beam scanning in 1 dimension may require only 1–2 signals while beam scanning in 2 dimensions may require only 3–4 signals. The fractal tree may be symmetrically arranged around the input port.

Each generator pattern of the fractal tree may be substantially identical and may have substantially identical numbers of time delay elements and time delay elements have substantially identical time delays. Similarly, the time delay elements of the initiator pattern and generator patterns may be substantially identical or different in time delay and/or placement.

The beamformer may comprise only (radio frequency) RF-passive components. The beamformer may be integrated with printed-circuit antenna elements and may comprise an integrated, monolithic system on a printed circuit board.

BRIEF DESCRIPTION OF THE DRAWINGS

FIG. 3 relates the scanning direction vs. control signals applied to sets of delay elements in the first embodiment;

DETAILED DESCRIPTION OF PREFERRED EMBODIMENTS

The basis of the present beamformer is that multiple, controlled, time delay components may be distributed into a fractal RF feed network, and the main beam scanned by applying only a very limited number of unique control signals. To understand how the present beamformer operates, the nature of a fractal tree first must be understood. For background on fractal trees, the reader can consult the following reference: Douglas H. Werner, "The Theory and Design of Fractal Antenna Arrays," chapter 3 of *Frontiers in Electromagnetics,* edited by Douglas Werner and Raj Mittra, IEEE Press, 2000. In this work, the authors introduce fractal trees, and teach various methods of designing fractal based antenna arrays in terms of the antenna element locations and excitations. However, in this reference, methods of beam scanning and details of feed networks are not addressed.

Figure 7:
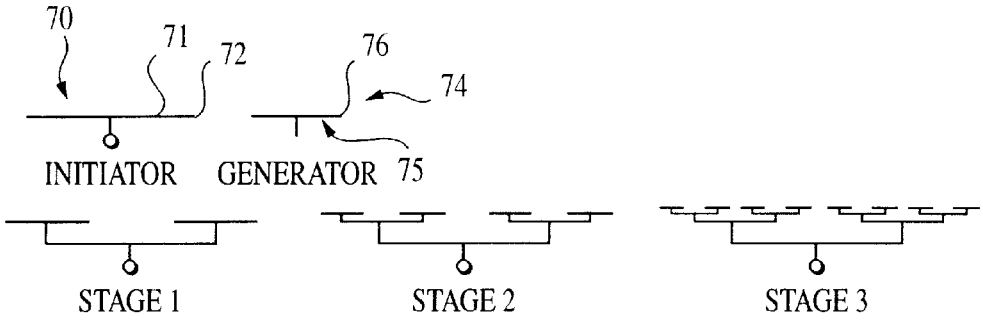
FIG. 7 shows the building blocks and various stages of a linear fractal tree.

Fractal trees can be built by starting with an initiator 70 and, in each stage, attaching a generator 74 to the end of each branch of the tree. FIG. 7 is an example of a deterministic fractal tree created by repeatedly applying a properly scaled generator 74 to the tips 72 of the branches 71 of the initiator 70. In each subsequent stage, the generator 74 is reduced in linear dimensions by a factor of 0.5 (although other scale factors could also be used). Building a fractal tree is a recursive process in which the n+1 stage is created from the $n^{th}$ stage by repeatedly attaching scaled generators 74 to the ends of the nth tree's branches (in this case, the tips 76 of the branches 75 of the previously most extreme generators 74 from the initiator 70). This example is called a linear fractal tree since the tips of the branches of the tree form a linear geometry. Three stages of growth are shown. The initiator 70 alone is referred to as stage 0.

Figure 8:
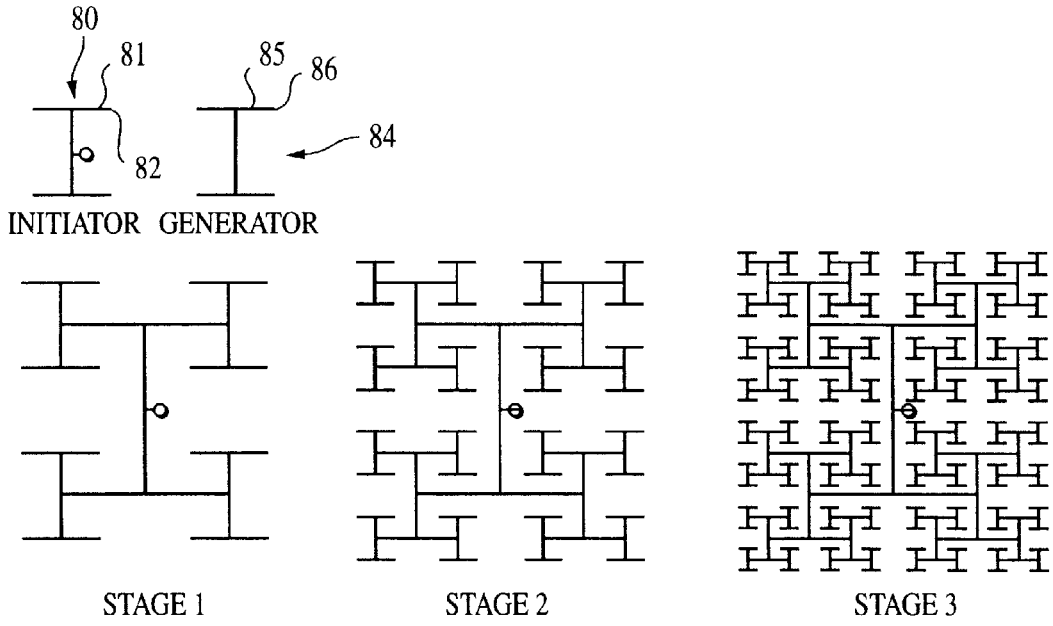
FIG. 8 shows the building blocks and various stages of a square fractal tree.

In another example shown in FIG. 8, a deterministic fractal tree is created by repeatedly applying a properly scaled generator 84 to the tips 82 of the branches 81 of the initiator 80. In each subsequent stage, the generator 84 is reduced in linear dimensions by a factor of 0.5. This is called a square fractal tree since the tips 86 of the branches 85 of the generator 84 form a square. Three stages of growth are shown, however, an infinite number of stages is conceivable. In this example, as the initiator 80 and generator 84 are identical except for scale, they are said to be self-similar. In general, the initiator 80 and generator 84 do not need to be self-similar. Furthermore, although the scale factor is not limited to 0.5, if it is not, the tips 86 of the branches 85 will not be uniformly spaced. The design of an antenna array is simplified if uniform spacing is assumed.

For the examples shown in FIG. 8, the stage 1 tree offers a square 4×4 array of beamformer outputs, while the stage 3 tree offers a square 16×16 array of outputs. These two examples of feed networks are also known as corporate feed networks. However, because not all fractal feed networks can be described as a classic one dimensional or two dimensional corporate feed network, the concept of fractal trees has been introduced to describe the most general case.

Figure 1:
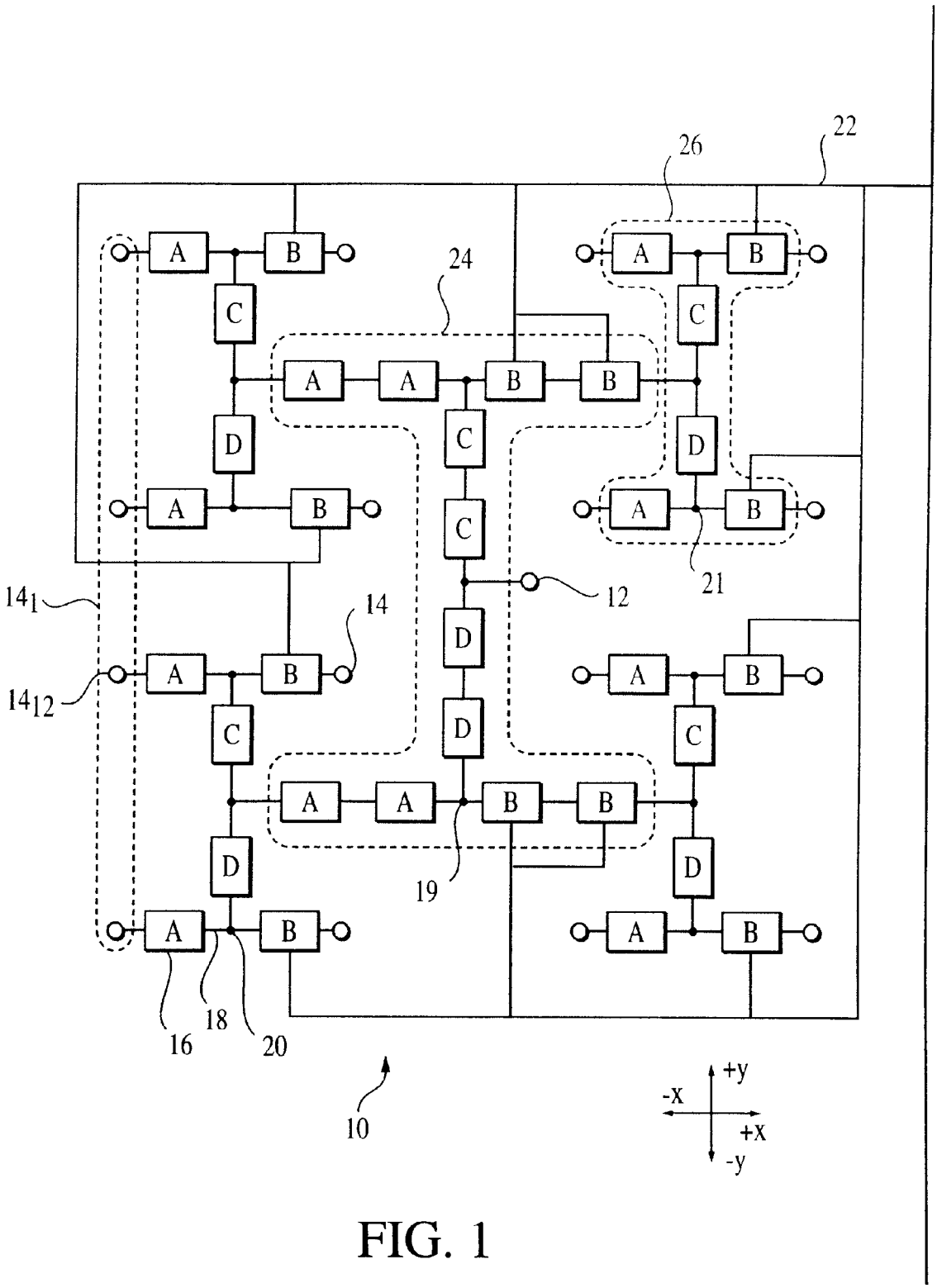
FIG. 1 illustrates a top view of a first embodiment of a beamformer scannable in two dimensions.

In a first embodiment of the present invention, a 4×4 time-delay beamformer that is steerable in two dimensions is illustrated in FIG. 1. The beamformer 10 may have a single common input port 12, sixteen output ports 14, and a plurality of transmission line delay elements 16, arranged in a generator pattern. The generator pattern is a replicated pattern containing an initiator pattern 24 and generator patterns 26 that are self-similar, albeit physically and electrically smaller than, the initiator pattern 24.

In this embodiment of a fractal feed network, the generator pattern 26 has electrical dimensions one-half the size of the initiator pattern 24. Subsequent replications of the generator pattern 26 are smaller by another factor of one-half. Transmission lines 18 connect the delay elements 16 with each other and with the input port 12 or output ports 14. The output ports 14 are connected with radiating elements (not shown). The electromagnetic signals transmitted at the output ports 14 have a maximum wavelength of transmission. Thus, the output ports 14 are spaced between about 0.4 to about 0.8 of the maximum wavelength apart. T junctions 19, 20 (or T intersections) of the transmission lines 18 form multiple corporate power dividers, which divide the power of the signal into either equal or unequal parts as desired.

The delay elements 16 may be integrated within the printed fractal feed network, producing an integrated, planar true time-delay (rather than phase delay) beamformer 10. The transmission lines 18 may be constructed from any material having a large bandwidth and that allows signals to propagate with low loss. Typical transmission lines may be microstrip, stripline, coplanar waveguide, or other technologies that employ conductors such as copper, aluminum, silver, gold, or a comparable alloy.

The controllable delay elements 16 of the present invention delay or enhance the propagation of an electromagnetic signal in time, rather than shifting the phase of the signal during propagation. The delay element 16 is a broadband element that provides a constant time delay independent of the signal frequency over a broad range of frequencies. Examples of the range of frequencies over which the time delay of the delay element 16 remains substantially constant may include one or more octaves in the microwave or millimeter wave frequency regime. The pointing angle of the electromagnetic gain pattern from the beamformer 10 may correspondingly remain constant over a wide range of frequencies, thereby permitting its use in broadband or multi-frequency arrays. The delay elements 16 thus may not limit the range of constant delay of the beamformer 10. For example, either the bandwidth of radiating elements connected with the output ports 14 or the physical spacing of the output ports 14 may limit this range. In the latter case, if the physical spacing of the output ports 14 is greater than about 0.8 of the free space wavelength of the radiated signal, grating lobes may be formed, while if the physical spacing of the output ports 14 is less than about 0.3 of the wavelength of the radiated signal, efficient antennas may not be formed.

The delay elements 16 may be fabricated on a printed circuit board using conventional processes and thus may be integrated with the remainder of the array elements. Creation of the beamformer 10 by monolithic fabrication may eliminate the need for separately packaged, expensive, and RF-active components (e.g. phase shifters) and lower the cost of fabricating the array. Thus, the addition of such time delay components may result in a thin, low cost array without drop-in or RF-active devices i.e. no amplifiers or other active components. By using monolithic integration rather than discrete components, impedance mismatches between the delay elements 16 and the transmission lines 18 may be decreased, correspondingly decreasing the amount of reflection between the two components, and thereby may result in lower RF losses.

In addition, because the beamformer 10 in such an embodiment is planar, the length of transmission line 18 between the input port 12 and any output port 14 may be minimized. This may further decrease loss through the beamformer 10 and permit the RF-passive beamformer 10 to be used for some applications. The planar beamformer 10 may be integrated with printed-circuit antenna elements such as patches (not shown), which may be fabricated on the same substrate as the beamformer 10. The antennas may also be fabricated on other layer(s), which may be laminated to the beamformer 10 or combined with the beamformer using standard PCB processes, and interconnected to the beamformer 10 using printed-circuit vias, z-wires, or coupling slots, for example. Thus, an entire, functional phased array may be fabricated in a printed-circuit process, using one or multiple layers.

The delay elements 16 may have a time delay that is controlled via a control signal 22. The control signals 22 may be set by a microprocessor or other control circuit (not shown) and optimize the pointing direction of the beam formed by the electromagnetic signals emitted by the radiating elements. The time delay of each delay element 16 may be continuously variable, incrementally variable, permanently set after being varied for the first time, or infrequently adjusted on an as-needed basis.

The control signals 22 may be analog-based signals or digital-based signals. The analog signals may be current or voltage control signals that continuously vary the time delay of a particular delay element 16. For example, the delay element 16 may consist of at least one variable time delay transmission line segment whose time delay from one end to the other is set by the control signal 22. In this example, the time delay through the delay element 16 may be adjustable by controlling the shunt capacitance of the delayer's transmission line model. Furthermore, the shunt capacitance may be reduced when a non-zero bias voltage is applied. Such is the case for some varactor-tuned transmission lines. The phase delay of a signal traveling from one end to the other end of the transmission line segment is given approximately (in the linear regime of variation) by:

$$\theta \approx \beta_0 L\left(1 - \frac{mX_{bias}}{2C_0}\right)$$

where:

$\theta$ = phase delay, $\beta_0 = \frac{2\pi}{\lambda}$ = phase constant of the unbiased trasmission line segment, $\lambda$ = wavelength of the electromagnetic signal propagating through the transmission line segment, $L$ = length of the transmission line segment, $C_0$ = capacitance/unit length of the unbiased transmission line segment, and $m$ = slope of the capacitance vs. amount of bias curve $X_{bias}$ = amount of bias applied to the trasmission line segment ($X$ may be either $I$ = current or $V$ = Voltage)

In the above mathematical example for the delay element 16, the time delay is reduced when a non-zero bias signal is applied. However, the delay element 16 may have a time delay response such that the insertion delay is increased upon application of a bias voltage or current.

Alternatively, digital signals may be used to incrementally change the time delay between the input and output of the delay element 16. In one embodiment, shown in FIG. 2*a*, the delay element 16 may have a plurality of generator patterns 30 connected in parallel, with each generator pattern 30 having a pair of normally open, single-pole switches 34 (switching devices) connected in series with a delayer 32, each delayer 32 having a different preset time delay. A pair of normally open switches 34 are used as any generator patterns 30 that remain connected will be a reactive load to the through transmission line at the location where they are still connected, thereby exacerbating the return and insertion loss of the delayer 16.

Figure 2A:
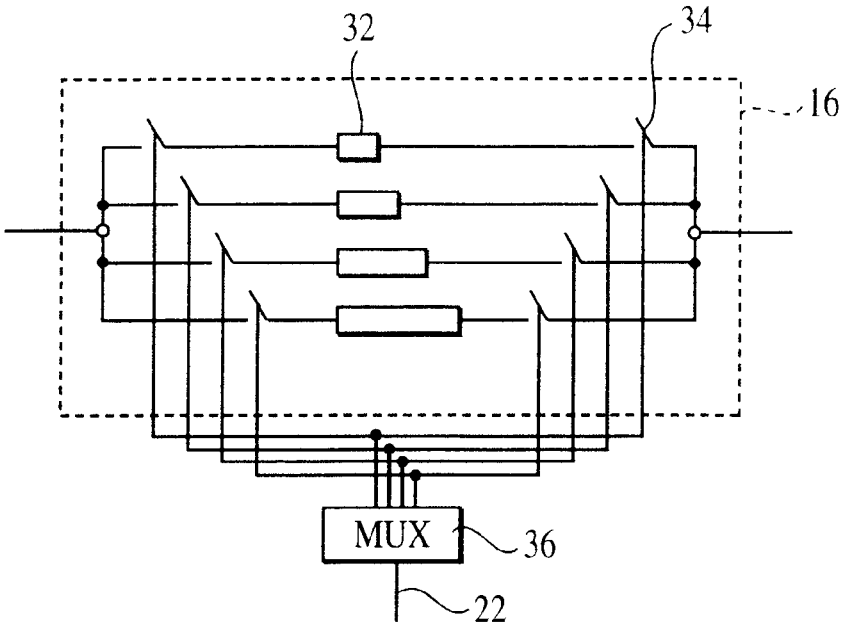
FIG. 2*a* shows a first embodiment of a digitally controlled delay element.
Figure 2B:
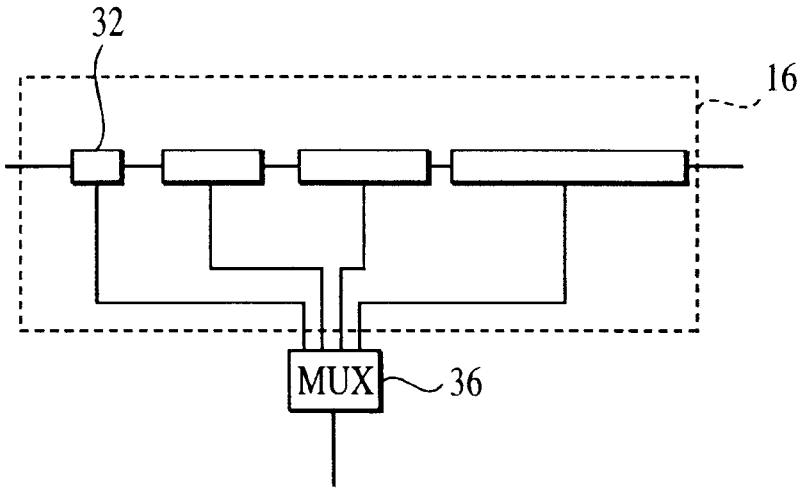
FIG. 2*b* shows a second embodiment of a digitally controlled delay element.

As further illustrated in FIG. 2*a*, the digital signal 22 may control a multiplexer 36 that closes associated pairs of the switches 34 and thus selects one of the delayers 32 (time delay) to act as the overall time delay across the delay element 16. Alternatively, as shown in FIG. 2*b*, each delay element 16 may have a plurality of delayers 32 with either the same time delay or different time delays connected in series. The digital signal 22 controlling the multiplexer 36 may then actuate from none of the delayers 32 (no time delay) to all of the delayers 32 (maximum time delay) to form the overall time delay across the delay element 16. The switches 34 may be PIN diodes, MOSFETS, BJTs, MESFETs or any other type of transistor or switching element known in the art of electronic switching, including switches such as MEMS-based RF switches. The multiplexer 36 may be implemented using digital logic, analog circuitry or in any other manner known in the art of multiplexing electronic signals.

As FIG. 1 shows, the fractal feed network of the present invention contains an initiator pattern 24 and generator patterns 26 that are self-similar to the initiator pattern 24. In one embodiment of the fractal tree, the initiator pattern and generator patterns are self-similar, i.e. they have the same shape only scaled in linear dimensions. The generator patterns 26 have a similar number and formation of T intersections 20 of the transmission lines as the initiator pattern 24. However, individual generator patterns 26 may have a different number of delay elements 16 from either the initiator pattern 24 or subsequent stages of generator patterns 26. For example, in the first embodiment of the present invention, the number of delay elements 16 between transmission line intersections 19 in the initiator pattern 24 is twice that of the number of delay elements 16 between the corresponding transmission line intersections 21 in each generator pattern 26. In addition, in the first embodiment, the initiator pattern 24 is symmetric around the input port 12: the transmission line intersections 19 are symmetrically arranged around the input port 12 and the same number of delay elements 16 exist between each transmission line intersection 19. Similarly each generator pattern 26 is identical to the other generator patterns 26, the generator patterns 26 are symmetrically arranged, and, as in the initiator pattern 24, the same number of delay elements 16 exist between each transmission line intersection 21 in each generator pattern 26.

Other advantages of using the embodiment illustrated in FIG. 1 may originate from the individual delay elements 16 being identical. By using identical delay elements 16, the beamformer 10 may be easier to design and fabricate and may have a lower cost (if discrete components are used). Further, the linearity and response performance of the beamformer 10 may be improved when using identical delay elements 16. This may be especially important for a beamformer 10 having a large number of delay elements 16.

The delay elements 16 are thus distributed throughout the generator pattern rather than being lumped near the output ports 14. Because of the distribution of the delay elements 16, fewer control signals 22 are necessary to control the direction of the signal emitted from the beamformer 10, i.e. to scan the beamformer 10 in one or more directions as one control signal 22 controls multiple delay elements 16. In one case, the number of unique control signals 22 controlling the delay elements 16 may be about the number of principal plane directions (+x axis, −x axis, +y axis, −y axis) in which scanning may occur. For example, only four unique control signals are needed to scan the beam in both the xz and yz planes as formed by the beamformer 10. Furthermore, for general 2D beam steering, only two of these four control signals must be nonzero.

The quantity of delay elements in the beamformer of FIG. 1 may be calculated using a simple mathematical expression. In general, for a 2n×2n square array, the number of delay elements 16 is given by $3*(2^{2n}-2^{n})$, where n is a natural number indicating one-half the number of beamformer outputs in each row. Thus, for a 4×4 array, n=2, and the number of equal length delay elements 16 is $3*(2^{4}-2^{2})=36$.

In the embodiment shown in FIG. 1, for example, one unique control signal 22 controls about ¼ of the total delay elements 16. Only four control signals may thus be used to control thirty-six delay elements 16: six on each of the four generator patterns 26 and twelve in the initiator pattern 24. In FIG. 1, all of the delay elements 16 denoted by same letter are connected with and controlled by the same unique control signal 22. For example, all of the delay elements 16 denoted the letter "A" may be activated at the same time and with the same bias amplitude to produce the same delay. Only one of the control signals 22, the control signal 22 controlling "B" delay elements 16, is shown for clarity in FIG. 1. Thus, the application of only four delay settings, i.e. control signals 22, yields scanning of the beam formed by the beamformer 10 independently in both x and y (or θ and φ) directions. Numerous advantages occur from decreasing the number of control signals 22 including low packaging volume of the beamformer 10, lower power requirements, and the elimination of dense control wiring. Further, a complex antenna control unit (microprocessor) including software programs may not be necessary to control all of the delay elements 16 individually.

For example, in the embodiment shown in FIG. 1, if the bias applied to all of the delay elements 16 is identical, no scanning is possible and a boresight beam results. However, if at least one set of delay elements 16 has a non-identical bias signal applied, scanning of the beam off boresight is realized. In one example, all of the delay elements 16 denoted "B" are set to a delay of one time unit (relative to an arbitrary reference delay) and all other delay elements 16, sets "A", "C" and "D", are set to have no relative delay. Tracing the signal paths through the beamformer 10 from the input port 12 to the different output ports 14, one sees that there is no relative time delay at the leftmost column of output ports $\mathbf{14}_1$ as none of the delay elements 16 through which the electromagnetic signal passes are activated. For example, from the input port 12 to the output port $\mathbf{14}_{12}$, the electromagnetic signal passes through two "D" delay elements 16, two "A" delay elements 16, one "C" delay element 16, and another "A" delay element 16, none of which have a relative delay. Continuing, the relative time delay at the next leftmost column of output ports is one time unit as the electromagnetic signal must pass through one "B" delay element; the relative time delay at the next rightmost column of output ports is two time units, and the relative delay at the rightmost column of output ports is three time units. This situation results in a beam scanned in the "+x" direction of the xz plane by virtue of progressive time delays for each column of beamformer output ports. For the sake of clarity, only the leftmost column of output ports $\mathbf{14}_1$ are shown in FIG. 1.

Similarly, if the all of the delay elements 16 denoted "C" are set to a delay of one time unit, with the remaining delay elements unbiased, there is no relative delay at the lowermost row of output ports, the relative time delay at the next lowermost row of output ports is one time unit, the relative time delay at the next to highest row of output ports is two time units, and the relative time delay at the highest row of output ports is three time units. This situation results in a beam scanned in the "+y" direction of the yz plane.

FIG. 3 shows a table of biases (X) applied to the four different sets of delay elements 16 of FIG. 1 and the resultant scanning direction created. A 1 or a 0 in this table indicates the presence or absence, respectively, of a nonzero biasing signal. Of course, scanning may be either continuous or discontinuous in any particular direction. Furthermore, this table assumes that the time delay is increased when the delay elements are biased. If one employs a type of time delay element whose insertion delay decreases with applied bias voltage, then the beampointing directions will be reversed or rotated by 180° in azimuth.

Figure 4:
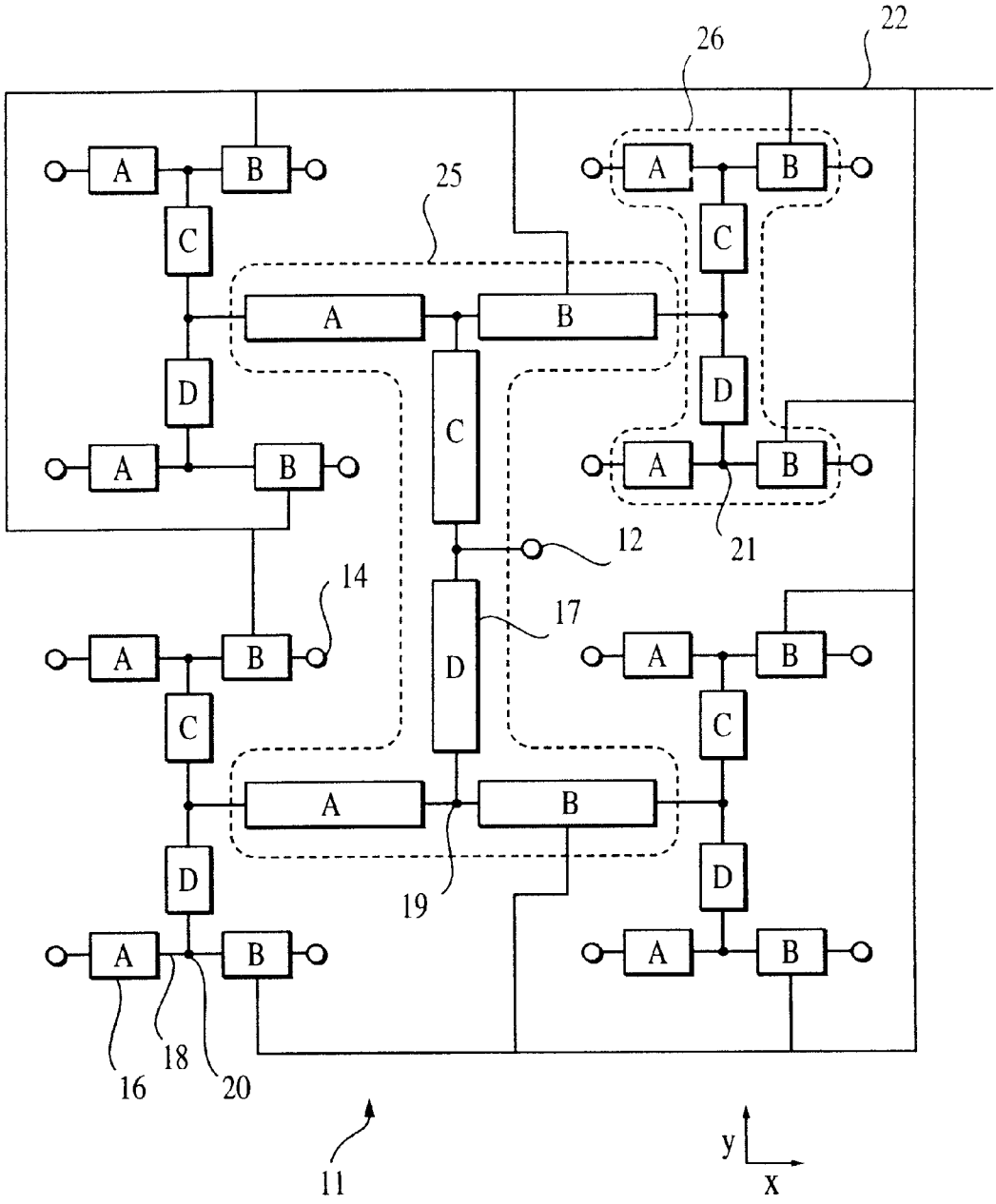
FIG. 4 illustrates a top view of a second embodiment of a beamformer scannable in two dimensions.

Another, slightly different embodiment of the beamformer is shown in FIG. 4. Whereas in the first embodiment, shown in FIG. 1, all of the delay elements 16 were similar in that they had equal ranges of time delays, in the second embodiment of the beamformer 11, the delay elements 17 in the initiator pattern 25 have twice the range of the delay of the corresponding delay elements 16 in the generator patterns 26. However, compared to the first embodiment, only half the number of delay elements 17 are used in the initiator pattern 25 of the second embodiment. The resulting time delay profile of the beamformer 11 of the second embodiment is thus identical to the time delay profile of the beamformer 10 of the first embodiment. One advantage of using fewer devices to achieve the same time delay profile is a decrease in mismatch loss caused by possible impedance mismatch between the delay elements 17 and the transmission lines 18. If discrete delay elements 17 are preferred rather than integrated devices the cost of the beamformer may be correspondingly reduced with the number of delay elements 17.

Yet another embodiment of a planar fractal feed network (not shown) is a fractal tree similar to that illustrated in FIG. 1, except that only a portion of the delay components are present, the portion required for one-dimensional beam steering. For instance, if delay elements 16 denoted as "A" and "B" remain, but delay elements denoted as "C" and "D" are removed, then the beam scanning will be limited to the xz plane.

The beamformers in the above embodiments may be extended for use with antenna arrays of any size or number of delay elements. Through recursion, an 8×8 beamformer (for a 64 element array) may be designed which consists of four of the circuits shown in FIG. 1, interconnected by another power divider 24 that is twice as large as the larger power divider shown, and having four delayers in each arm. This would be a stage 3 fractal tree.

The power division of the T junctions 19, 20 is not necessarily an equal split; an unequal split may also be created. If the power division is equal, a uniformly illuminated array results. By using unequal power division in some of the T junctions, an amplitude taper may be applied to the array, which reduces sidelobe levels of the resulting antenna pattern. Unequal split may also be used to create arrays that are not square in shape [i.e. do not have $3*(2^{2n}-2^{n})$ delay elements, where n=a natural number], or which have a non-even number of elements.

Figure 5:
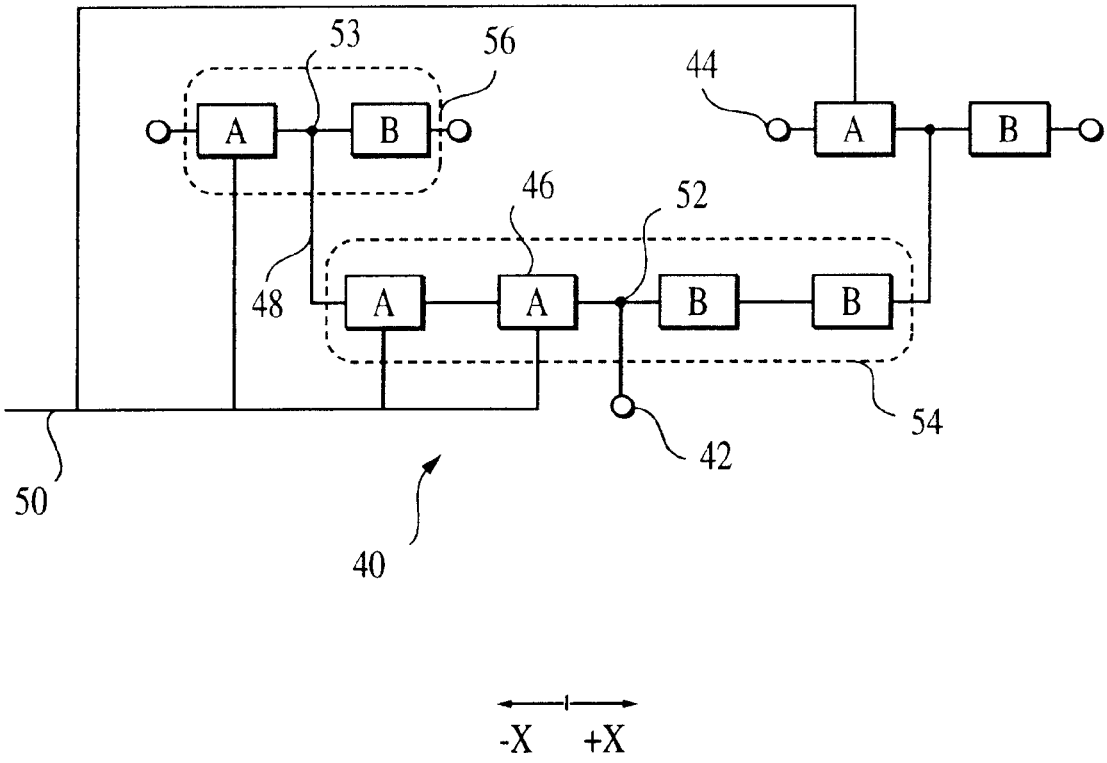
FIG. 5 illustrates a top view of an embodiment of a beamformer scannable in one dimension.
Figure 6:
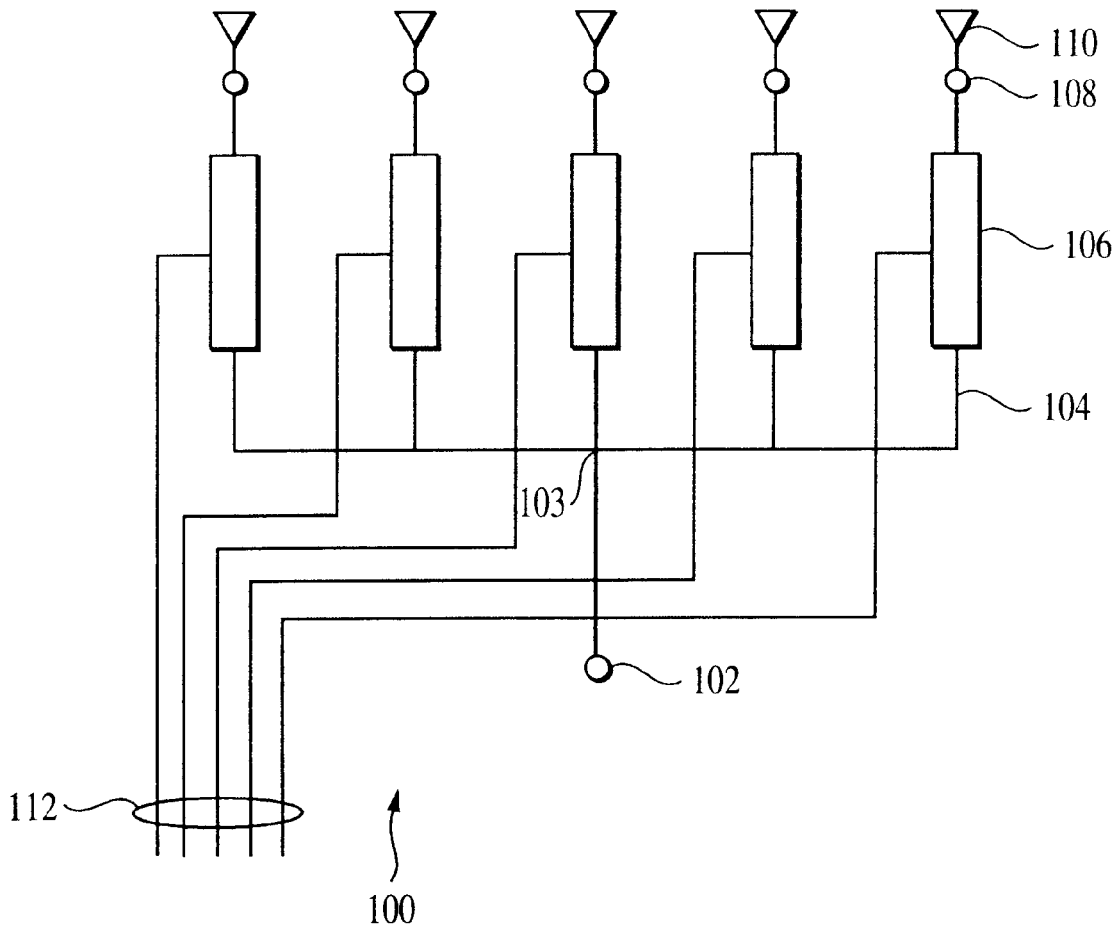
FIG. 6 PRIOR ART
FIG. 6 depicts a conventional beamformer.

In another embodiment of the invention, illustrated in FIG. 5, the beamformer 40 may be configured to support one-dimensional scanning of a linear array. In FIG. 5, one input port 42, four output ports 44, three T junctions 52, 53, eight identical delay elements 46, and transmission lines 48 linking these components are present. As in the two-dimensional structure, the eight delay elements 46 are distributed between an initiator pattern 54, which has four delay elements 46, and two generator patterns 56, which have the other four delay elements 46. All of the delay elements 46 are aligned in the same linear direction. Of the eight delay elements 46, one set of four are controlled by a first control signal 50 and denoted "A," and the other set of four are controlled by a second control signal (not shown) and denoted "B". Each control signal 50 will uniformly adjust the time delay in delay elements denoted as "A" which allows the antenna pattern to be scanned in the xz plane. The generator patterns 56 are identical, each having a single delay element 46 controlled by the first control signal 50 on one side of the T junction 53 forming the generator pattern 56 and a single delay element 46 controlled by the second control signal on the other side of the T junction 53 forming the generator pattern 56. The generator patterns 56 are symmetrically disposed around the ends of the initiator pattern 54. The initiator pattern 54 has two delay elements 46 controlled by the first control signal 50 on one side of the T junction 52 forming the initiator pattern 54 and a two delay elements 46 controlled by the second control signal on the other side of the T junction 52 forming the initiator pattern 54.

The manner in which the feed network for the linear array operates is similar to the manner in which the two-dimensional fractal tree operates. The linear beamformer 40 may be operated in a boresight mode, in which none of the delay elements 46 are actuated, or may be scanned in either the +x or −x direction of the xz plane. For example, to actuate the linear beamformer 40 such that the main beam points in the −x direction (to the left in FIG. 5), the delay elements 46, denoted as "A", connected with the first control signal 50 may be actuated, while the delay elements 46, denoted as "B", connected with the second control signal remain unactuated. In this example, actuating the delay element means the time delay is increased. In this case, electromagnetic signals introduced from the input port 42 into the linear beamformer 40 would suffer no relative delay in reaching and being emitted from the rightmost output port; a relative delay of one unit in reaching and being emitted from the next rightmost output port; a relative delay of two units in reaching and being emitted from the next leftmost output port; and a relative delay of three units in reaching and being emitted from the leftmost output port.

Alternatively, as in the two-dimensional array, rather than having a pair of delay elements 46 disposed on either side of the T junction 52 of the initiator pattern 54 with each delay element 46 identical to those in the generator patterns 56, a single delay element 46 having twice the delay may replace one or both of the pair of delay elements 46 on each side of the junction 52.

A planar array may be composed of vertically-disposed columns of antenna elements, each column being fed at one end by one output port of a fractal feed network. A planar beamformer with a number of output ports equal to the number of columns may be configured to feed the columns, resulting in an array with one-dimensional beam steering. Such an array may have a fixed elevation beam, which may be steered in azimuth. This embodiment may have cost, size, and efficiency advantages relative to two-dimensional beamformers.

While the invention has been described with reference to specific embodiments, the description is illustrative of the invention and not to be construed as limiting the invention. Various modifications and applications may occur to those skilled in the art without departing from the true spirit and scope of the invention as defined in the appended claims.

We claim:

1. A beamformer comprising:

an input port configured to receive an input electromagnetic signal;

output ports configured to provide output electromagnetic signals; and controllable time delay elements disposed between the input port and the output ports, a number of control signals that control the time delay elements different from a number of time delay elements;

wherein the time delay elements are distributed within a feed network that includes a fractal tree which contains an initiator pattern connected with the input port and a plurality of generator patterns, the initiator pattern includes a first set of the time delay elements, each generator pattern includes a second set of the time delay elements and is connected with two of: the initiator pattern, at least one of the output ports, and at least one other generator pattern, and wherein at least one time delay element of each of the first and second set of the time delay elements are connected with each other such that the at least one time delay element of each of the first and second set of the time delay elements are controllable by a single control signal.

2. The beamformer of claim 1, wherein power of each output electromagnetic signal is substantially identical.

3. The beamformer of claim 1, wherein each time delay element is controlled by an analog signal, the analog signal being one of a voltage and a current.

4. The beamformer of claim 1, wherein each time delay element is controlled by a digital signal.

5. The beamformer of claim 4, each time delay element comprising a plurality of branches, each having a pair of switching devices connected in series with different time delays, the branches connected in parallel, wherein the digital signal selects only one of the different branches to act as the time delay.

6. The beamformer of claim 4, wherein each time delay element comprises a plurality of delayers connected in series, each delayer having a different time delay, wherein the digital signal activates from none to all of the plurality of delayers.

7. The beamformer of claim 1, wherein each of the second set of time delay elements contains multiple time delay elements that are controlled independently of each other.

8. The beamformer of claim 7, wherein the time delay elements are controlled by between one and four control signals for beam scanning in one to two dimensions.

9. The beamformer of claim 8, wherein each generator pattern for a given fractal stage in the fractal feed network is substantially identical.

10. The beamformer of claim 8, wherein the first set of the time delay elements has substantially twice the number of time delay elements as the second set of the time delay elements.

11. The beamformer of claim 10, wherein the time delay elements have substantially identical ranges of controlled time delays.

12. The beamformer of claim 9, wherein the time delay elements of the first set of the time delay elements have different time delays from corresponding time delay elements of the second set of the time delay elements.

13. The beamformer of claim 12, wherein the time delay elements of the first set of the time delay elements have time delays about twice as long as corresponding time delay elements of the second set of the time delay elements.

14. The beamformer of claim 8, wherein the first set of the time delay elements and the second set of the time delay elements have different numbers of time delay elements.

15. The beamformer of claim 14, wherein the time delay elements have substantially identical time delays.

16. The beamformer of claim 14, wherein a time delay of each time delay element of the first set of the time delay elements is substantially equal to a time delay of a plurality of time delay elements of the second set of the time delay elements.

17. The beamformer of claim 14, wherein a time delay of each time delay element of the first set of the time delay elements is substantially equal to a time delay of two time delay elements of the second set of the time delay elements.

18. The beamformer of claim 1, wherein a pointing angle of an electromagnetic beam radiated from the beamformer remains substantially constant over a wide range of frequencies of the electromagnetic beam, being limited by a spacing and bandwidth of radiating elements connected with the output ports.

19. The beamformer of claim 1, wherein the fractal tree is symmetrically arranged around the input port.

20. The beamformer of claim 1, wherein the fractal tree is arranged such that a plurality of T junction power dividers are disposed between the input port and each output port, power of an electromagnetic signal entering each power divider is split substantially equally at a junction of the T junction.

21. The beamformer of claim 1, wherein the fractal tree is arranged such that a plurality of T junction power dividers are disposed between the input port and each output port, power of an electromagnetic signal entering some of the power dividers being split unequally at a junction of the T junction.

22. The beamformer of claim 21, further comprising amplitude tapers disposed within the fractal feed network to reduce sidelobe levels of an antenna pattern formed from electromagnetic signals emitted from the fractal feed network.

23. The beamformer of claim 21, wherein the output ports of the fractal tree form a non-square shape.

24. The beamformer of claim 22, wherein the number of time delay elements is other than $3*(2^{2n}-2^{n})$, where $2^{2n}$ is a number of output ports of the fractal tree.

25. The beamformer of claim 1, wherein the output ports of the fractal tree form a square shape.

26. The beamformer of claim 1, wherein the number of time delay elements is exactly $3*(2^{2n}-2^{n})$, where $2^{2n}$ is a number of output ports of the fractal tree.

27. The beamformer of claim 1, wherein the beamformer comprises only radio frequency passive components.

28. The beamformer of claim 1, wherein the beamformer comprises integrated printed-circuit antenna elements.

29. The beamformer of claim 1, wherein the beamformer comprises an integrated, monolithic system on a printed circuit board.

30. The beamformer of claim 1, wherein the output electromagnetic signals have a maximum wavelength of transmission such that the output ports are spaced between about 0.4 to about 0.8 of the maximum free space wavelength apart.

31. The beamformer of claim 1, wherein a time delay of the time delay elements is adjustable only once thereby permanently setting the time delay of the time delay elements.

32. The beamformer of claim 1, wherein a time delay of each time delay element is increased from an unactivated time delay when one of the control signals is applied to the time delay element to activate the time delay.

33. The beamformer of claim 1, wherein a time delay of each time delay element is decreased from an unactivated time delay when one of the control signals is applied to the time delay element to activate the time delay.

34. The beamformer of claim 1, wherein a time delay of each time delay element is both increasable and decreasable from an unactivated time delay dependent on one of the control signals applied to the time delay element to activate the time delay.

35. A beamformer comprising:

an input means for receiving an input electromagnetic signal;

a plurality of output means for providing an output electromagnetic signal;

distribution means for distributing electromagnetic signals through a fractal tree; and a plurality of time delay means for selectively delaying the distributed electromagnetic signals, the time delay means distributed within the fractal tree, a number of control signals that control the time delay means different from a number of time delay means, wherein the fractal tree contains an initiator pattern connected with the input means and a plurality of generator patterns, the initiator pattern includes a first set of the time delay means, each generator pattern includes a second set of the time delay means and is connected with two of: the initiator pattern, at least one of the output means, and at least one other generator pattern, and wherein at least one time delay means of each of the first and second set of the time delay means are connected with each other such that the at least one time delay means of each of the first and second set of the time delay means are controllable by a single control signal.

36. The beamformer of claim 35, wherein each time delay means is controlled by a digital electronic signal.

37. The beamformer of claim 35, wherein each of the second set of the time delay means contains multiple time delay means that are controlled independently of each other.

38. The beamformer of claim 35, wherein the time delay means are controlled by between one and four control signals for beam scanning in one to two dimensions.

39. The beamformer of claim 35, wherein each time delay means is substantially identical.

40. The beamformer of claim 35, wherein each time delay means has a substantially different time delay from other time delay means.

41. The beamformer of claim 35, wherein the time delay means are distributed symmetrically.

42. The beamformer of claim 35, wherein a pointing angle of an electromagnetic beam radiated from the beamformer remains substantially constant over a wide range of frequencies of the electromagnetic beam, being limited by a spacing and bandwidth of radiating means connected with the output means.

43. The beamformer of claim 35, wherein power of the output electromagnetic signals is substantially identical.

44. The beamformer of claim 35, wherein power of at least one output electromagnetic signal is different from power of the other output electromagnetic signals.

45. The beamformer of claim 44, further comprising a taper means for reducing sidelobe levels of the output electromagnetic signals.

46. The beamformer of claim 35, wherein the time delay means are radio frequency passive.

47. The beamformer of claim 35, wherein a time delay of the time delay means are adjustable only once thereby permanently setting the time delay of the time delay means.

48. The beamformer of claim 35, wherein a time delay of each time delay means is increased from an unactivated time delay when one of the control signals is applied to the time delay means to activate the time delay.

49. The beamformer of claim 35, wherein a time delay of each time delay means is decreased from an unactivated time delay when one of the control signals is applied to the time delay means to activate the time delay.

50. The beamformer of claim 35, wherein a time delay of each time delay means is both increasable and decreasable from an unactivated time delay dependent on one of the control signals applied to the time delay means to activate the time delay.

51. A method for forming an electromagnetic beam, the method comprising:

receiving an input electromagnetic signal in an input port;

responsive to the input electromagnetic signal, distributing electromagnetic signals through a fractal tree;

transmitting the distributed electromagnetic signals through time delay elements distributed throughout the fractal tree having an initiator pattern and a plurality of generator patterns connected with the initiator pattern;

controlling the time delay elements with a number of control signals different from a number of time delay elements, arranging the time delay elements such that a first set of the time delay elements in the initiator pattern are connected with the input port and a second set of the time delay elements in each generator pattern is connected with one of an output port and recursively to another stage of the plurality of generator patterns, and limiting the number of control signals to fewer than the number of time delay elements such that at least one time delay element of each of the first and second set of the time delay elements are connected with each other such that the at least one time delay element of each of the first and second set of the time delay elements are controllable by a single control signal;

emitting the delayed distributed electromagnetic signal from a plurality of output ports; and radiating a main beam from an array of antenna elements connected to the output ports.

52. The method of claim 51, further comprising steering the main beam of the beamformer when the beamformer is operated.

53. The method of claim 51, wherein the electromagnetic signals are distributed such that power of each output electromagnetic signal is substantially identical.

54. The method of claim 51, further comprising scanning the main beam from the fractal tree in exactly one dimension.

55. The method of claim 51, further comprising scanning the main beam from the fractal tree in exactly two dimensions.

56. The method of claim 51, further comprising continuously varying the time delay of at least one the time delay element using an analog signal.

57. The method of claim 51, further comprising incrementally varying the time delay of at least one the time delay element using a digital signal.

58. The method of claim 51, further comprising selecting one time delay by completing a transmission path through one of a plurality of parallel-connected delayers having different time delays.

59. The method of claim 51, further comprising activating from none to all of a plurality of series-connected delayers having different time delays.

60. The method of claim 51, further comprising controlling the time delay elements using fewer unique control signals than the number of time delay elements.

61. The method of claim 51, further comprising distributing the electromagnetic signals symmetrically from the input port to the output ports.

62. The method of claim 51, further comprising permanently setting the time delay of the time delay elements by adjusting the time delay of the time delay elements exactly once.

63. The method of claim 51, further comprising increasing the time delay of at least one time delay element from an unactivated time delay when controlling the time delay element.

64. The method of claim 51, further comprising decreasing the time delay of at least one time delay element from an unactivated time delay when controlling the time delay element.

65. The method of claim 51, further comprising one of increasing and decreasing the time delay of at least one time delay element, whose time delay is both increasable and decreasable, from an unactivated time delay when controlling the time delay element.

66. A beamformer comprising:

an input port configured to receive an input electromagnetic signal;

output ports configured to provide output electromagnetic signals; and time delay elements disposed between the input port and the output ports, a plurality of the time delay elements being controllable by one of a plurality of control signals, a number of control signals that control a number of time delay elements different from the number of time delay elements, the time delay elements being distributed within a feed network arranged in a fractal tree, the fractal tree having an initiator pattern including a first set of the time delay elements connected with the input port and having a plurality of generator patterns connected with the initiator pattern, each generator pattern including a second set of the time delay elements and being connected with one of a set of the output ports and recursively to another stage of the plurality of generator patterns, wherein at least one time delay element of each of the first and second set of the time delay elements are connected with each other such that the at least one time delay element of each of the first and second set of the time delay elements are controllable by a single control signal.

67. The beamformer of claim 66, wherein power of each output electromagnetic signal is substantially identical.

68. The beamformer of claim 66, wherein each time delay element is controlled by an analog signal, the analog signal being one of a voltage and a current.

69. The beamformer of claim 66, wherein each time delay element is controlled by a digital signal.

70. The beamformer of claim 69, each time delay element comprising a plurality of branches, each having a pair of switching devices connected in series with different time delays, the branches being connected in parallel, wherein the digital signal selects only one of the different branches to act as the time delay.

71. The beamformer of claim 69, wherein each time delay element comprises a plurality of delayers connected in series, each delayer having a different delay, wherein the digital signal activates from none to all of the plurality of delayers.

72. The beamformer of claim 66, wherein between one and four control signals control time delay elements for beam scanning in one to two dimensions.

73. The beamformer of claim 72, wherein each generator pattern for a given fractal stage in the fractal feed network is substantially identical.

74. The beamformer of claim 72, wherein the first set of the time delay elements has substantially twice the number of time delay elements as the second set of the time delay elements.

75. The beamformer of claim 74, wherein the time delay elements have substantially identical ranges of controllable time delays.

76. The beamformer of claim 73, wherein the time delay elements of the first set of the time delay elements have different time delays from corresponding time delay elements of the second set of the time delay elements.

77. The beamformer of claim 76, wherein the time delay elements of the first set of the time delay elements have time delays about twice as long as corresponding time delay elements of the second set of the time delay elements.

78. The beamformer of claim 72, wherein the first set of the time delay elements and the second set of the time delay elements have different numbers of time delay elements.

79. The beamformer of claim 78, wherein the time delay elements have substantially identical time delays.

80. The beamformer of claim 78, wherein each time delay element of the first set of the time delay elements corresponds to a plurality of time delay elements of the second set of the time delay elements.

81. The beamformer of claim 66, wherein the fractal tree is arranged such that a plurality of T junction power dividers are disposed between the input port and each output port, power of an electromagnetic signal entering each power divider being split substantially equally at a junction of the T junction.

82. The beamformer of claim 66, wherein the fractal tree is arranged such that a plurality of T junction power dividers are disposed between the input port and each output port, power of an electromagnetic signal entering some of the power dividers being split unequally at a junction of the T junction.

83. The beamformer of claim 82, further comprising amplitude tapers disposed within the fractal feed network to reduce sidelobe levels of an antenna pattern formed from electromagnetic signals emitted from the fractal feed network.

84. The beamformer of claim 66, wherein the fractal tree has a square shape with exactly $3*(2^{2n}-2^{n})$ time delay elements, where n is a natural number.

85. The beamformer of claim 66, wherein the beamformer comprises only radio frequency passive components.

86. The beamformer of claim 66, wherein the output electromagnetic signals have a maximum wavelength of transmission such that the output ports are spaced between about 0.4 to about 0.8 of the maximum free space wavelength apart.

87. The beamformer of claim 66, wherein a time delay of the time delay elements are adjustable only once thereby permanently setting the time delay of the time delay elements.

88. The beamformer of claim 66, wherein a time delay of each time delay element is increased from an unactivated time delay when the control signal is applied to the time delay element to activate the time delay.

89. The beamformer of claim 66, wherein a time delay of each time delay element is decreased from an unactivated time delay when the control signal is applied to the time delay element to activate the time delay.

90. The beamformer of claim 66, wherein a time delay of each time delay element is both increasable and decreasable from an unactivated time delay dependent on the control signal applied to the time delay element to activate the time delay.

91. The beamformer of claim 1, wherein the beamformer is configured such that a main beam of the beamformer is steered when the beamformer is operated.

92. The beamformer of claim 35, wherein the beamformer is configured such that a main beam of the beamformer is steered when the beamformer is operated.

93. The beamformer of claim 66, wherein the beamformer is configured such that a main beam of the beamformer is steered when the beamformer is operated.

94. The beamformer of claim 1, wherein the beamformer is configured such that a main beam of the beamformer is scannable in one or two dimensions.

* * * * *

UNITED STATES PATENT AND TRADEMARK OFFICE

CERTIFICATE OF CORRECTION

PATENT NO. : 6,590,531 B2
DATED : July 8, 2003
INVENTOR(S) : William E. McKinzie, III et al.

It is certified that error appears in the above-identified patent and that said Letters Patent is hereby corrected as shown below:

Title page,
Item [56], References Cited, OTHER PUBLICATIONS, "Puente-Baliarda, C. et al," reference, after "vol. 46," insert -- no. 4, --.

Signed and Sealed this

Twenty-ninth Day of June, 2004

JON W. DUDAS
*Acting Director of the United States Patent and Trademark Office*